US011648433B2

(12) United States Patent
Dangelo

(10) Patent No.: US 11,648,433 B2
(45) Date of Patent: May 16, 2023

(54) MULTIPLE EXERCISE MACHINE ARRANGEMENT

(71) Applicant: DXID (NINGBO) INDUSTRIAL DESIGN CO., LTD., Ningbo (CN)

(72) Inventor: Rodrigo Dangelo, Curitiba-Paraná (BR)

(73) Assignee: DXID (NINGBO) INDUSTRIAL DESIGN CO., LTD., Ningbo (CN)

( * ) Notice: Subject to any disclaimer, the term of this patent is extended or adjusted under 35 U.S.C. 154(b) by 0 days.

(21) Appl. No.: 16/986,741

(22) Filed: Aug. 6, 2020

(65) Prior Publication Data

US 2021/0060373 A1 Mar. 4, 2021

(30) Foreign Application Priority Data

Aug. 29, 2019 (BR) ..... 2020190179789

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 21/22*** | (2006.01) |
| ***A63B 23/035*** | (2006.01) |

(Continued)

(52) U.S. Cl.

CPC ..... *A63B 21/0442* (2013.01); *A63B 21/055* (2013.01); *A63B 21/153* (2013.01); *A63B 21/22* (2013.01); *A63B 21/4033* (2015.10); *A63B 22/20* (2013.01); *A63B 23/03525* (2013.01); *A63B 21/4043* (2015.10); *A63B 23/1236* (2013.01)

(58) Field of Classification Search

CPC . A63B 21/0442; A63B 21/055; A63B 21/153; A63B 21/4033; A63B 21/0552; A63B 21/4034; A63B 21/4035; A63B 21/4043; A63B 22/20; A63B 23/03525; A63B 23/1236; A63B 17/04

See application file for complete search history.

(56) References Cited

U.S. PATENT DOCUMENTS 1,019,861 A * 3/1912 Titus ..... A63B 21/4043 482/123

4,982,958 A * 1/1991 Ullman ..... A63B 21/04 482/123

(Continued)

*Primary Examiner* — Megan Anderson

(74) *Attorney, Agent, or Firm* — Pilloff Passino & Cosenza LLP; Sean A. Passsino; Rachel K. Pilloff

(57) ABSTRACT

An exercise machine has a two-part hexagonal base. A plurality of supports is attached to the two-part hexagonal base, and a pair of intermediary elastics, each arranged by crossing one side extremity of the two-part hexagonal base from a top extremity of the exercise machine to the bottom face of the opposite extremity of the two-part hexagonal base. A top two-part bar is arranged horizontally between tops of the pair of intermediary elastics. A top cylindrical wheel arranged and centered on the top two-part bar, wherein the two-part hexagonal base having a set of cylindrical openings spaced along an entire length of the two-part hexagonal base, two side openings, two rollers, arranged transversally centered in a one of the two side openings, a bottom hollow arranged along the an entire length of the bottom of the two-part hexagonal base, two pairs of straight bottom bars arranged centered and spaced on and along the entire length of the bottom face of the two-part hexagonal base.

16 Claims, 15 Drawing Sheets

(51) Int. Cl.
*A63B 22/20* (2006.01)
*A63B 23/12* (2006.01)

(56) References Cited

U.S. PATENT DOCUMENTS

| | | | | |
|---|---|---|---|---|
| 6,500,105 | B1 * | 12/2002 | Kuo | A63B 21/0004 482/123 |
| 6,746,383 | B2 * | 6/2004 | Yu | A63B 21/015 482/123 |
| 7,326,157 | B2 * | 2/2008 | Wu | A63B 21/0004 482/121 |
| 7,946,969 | B1 * | 5/2011 | Friess | A63B 23/1209 482/123 |
| 8,088,050 | B2 * | 1/2012 | Aucamp | A63B 23/03533 482/131 |
| 8,721,507 | B2 * | 5/2014 | Blancher | A63B 21/0442 482/121 |
| 8,905,905 | B2 * | 12/2014 | Mangalindan | A63B 23/1236 482/141 |
| 9,873,013 | B2 * | 1/2018 | Williams | A63B 21/0023 |
| 10,695,608 | B2 * | 6/2020 | Engelfried, Jr. | A63B 21/4043 |
| 2016/0144217 | A1 * | 5/2016 | Oltorik, Jr. | A63B 23/03525 482/130 |
| 2021/0016133 | A1 * | 1/2021 | Wu | A63B 21/0601 |

* cited by examiner

MULTIPLE EXERCISE MACHINE ARRANGEMENT

CROSS-REFERENCE TO RELATED APPLICATION

This application claims priority to Brazilian Application No. 2020190179789, having a filing date of Aug. 29, 2019 the entire contents of which are hereby incorporated by reference.

FIELD OF TECHNOLOGY

The following relates to physical exercise machines in general, more specifically a multiple exercise machine arrangement which, according to its general characteristics, has an aspect of providing the formation of an exercise machine in a portable structure and specifically a mechanical type and is based on the concept of individualized physical conditioning through a two-part base, bottom supports, intermediary elastics, top two-part bar and bottom wheel, with the aim of enabling complete optimization in the routine procedures practiced by individual fitness enthusiasts in an extremely practical, safe and effective way through high versatility in the range of exercises that may be practiced, combined with the high strength and mobility of the set as a whole and, based on an exercise machine with great strength, safety and versatility.

BACKGROUND

The exercise machine has a specific design and format and is easy to use for better adaption and security for the user, practical handling and operating characteristics, reasonable price and, due to its general characteristics and dimensions, easily adaptable to a vast range of exercises, location and users in general, regardless of the characteristics that they may present.

Currently, individual exercise machines widely known for the current state of the art, have a low range of exercises that can be performed on the same platform, if not just a single exercise, as well as a low capacity for mobility and storage.

In this vein, it has become essential for physical exercise enthusiasts in general, primarily those using individualized exercises in general, the structuring of a versatile, safe, effective and portable system capable of performing a wide range of exercises on the same platform and that can be transported and stored in the most diverse locations.

In a broad study of the literature in order to establish the state of the of current technique in relation to physical exercise machines, primarily portable multiple exercise machines, aspect of this utility model, documents relevant to the state of the art that relate to the claims in this utility model were not described, i.e. an exercise machine that can be transported to the most diverse locations and allows a wide range of physical exercises on a single platform to be performed, integrated with a set of accessories.

Thus, the utility model under consideration is characterized by the fact that it brings together components and processes in a unique design, which will take the nature of the use demands into account, i.e. a practical and individualized range of physical exercise regardless of location. A design such as this one that guarantees an efficient, functional, strong, durable, safe, versatile, practical, precise and ergonomic exercise machine due to the excellent aggregated technical qualities, which provides advantages and improvements in physical exercise procedures in general and, whose general characteristics differ from other forms and widely known state of the art exercise machines.

This utility model consists of or includes the use of a modern, efficient, safe and functional multiple exercise machine arrangement formed by a set of mechanical solutions and physical conditioning correctly incorporated, composing a complete exercise machine and unique design, great finishing details, beautiful aesthetics and characteristics of its own, incorporating its own specific mechanical type structure, of high durability and resistance, and containing perfectly integrated and symmetrically arranged two-part base as a structuring element of the exercise machine, bottom supports as a support element and hand support on the two-part base during the exercises, intermediary elastics as a support element for the hands and the two-part bar during the exercises, intermediary elastic locks as a bottom attaching element of the intermediary elastics, top two-part bar as a support element for the hands, elastics and top weights during exercises, and top wheels as a support element and sliding of the bars during the exercises, in order to make the formation of a single, complete and safe set possible, whose forms and internal and external arrangements make it possible to adapt perfectly to the most diverse types of users and individualized physical exercises, especially designed for these purposes with its own geometry. Accordingly, the general design of this multiple exercise machine arrangement, aspect of this utility model, is based entirely on in its simple and strong structure with few extremely simplified components, safe and optimized operation, combined with very practical manufacturing and maintenance procedures, in order to generate a practical and efficient exercise machine that through its basic integrated components is able to generate an infinite range of exercises combined with its users that make performance in the most diverse muscles of the human body such as the shoulders/back, shoulders/chest, arms, legs/buttocks, arms/chest and abdominal/lumbar among others possible.

More specifically, this exercise machine is based on the application of components and processes in a unique design, without, however, achieving a high degree of sophistication and complexity, making it possible to solve some of the main drawbacks of other forms and models known in the current state of the art and used in the individualized physical conditioning procedures carried out through multiple exercise machines, which are in a working range in which the difficulties of use and application, low efficiency and performance and accidents are very frequent and the shapes and/or models are based on simple adaptations, thus being highly unsafe, of great deterioration and fragility, have low versatility; low yield, high losses, laborious in application, no ergonomics, low comfort and derisory performance, or are of large size, being of very high cost, high volume and overall weight, little flexibility, complex handling, high maintenance, great waste of time, complex manufacturing, low performance and little ergonomics and comfort.

BRIEF DESCRIPTION

Some of the embodiments will be described in detail, with reference to the following figures, wherein like designations denote like members, wherein.

DETAILED DESCRIPTION

Figure 1A:
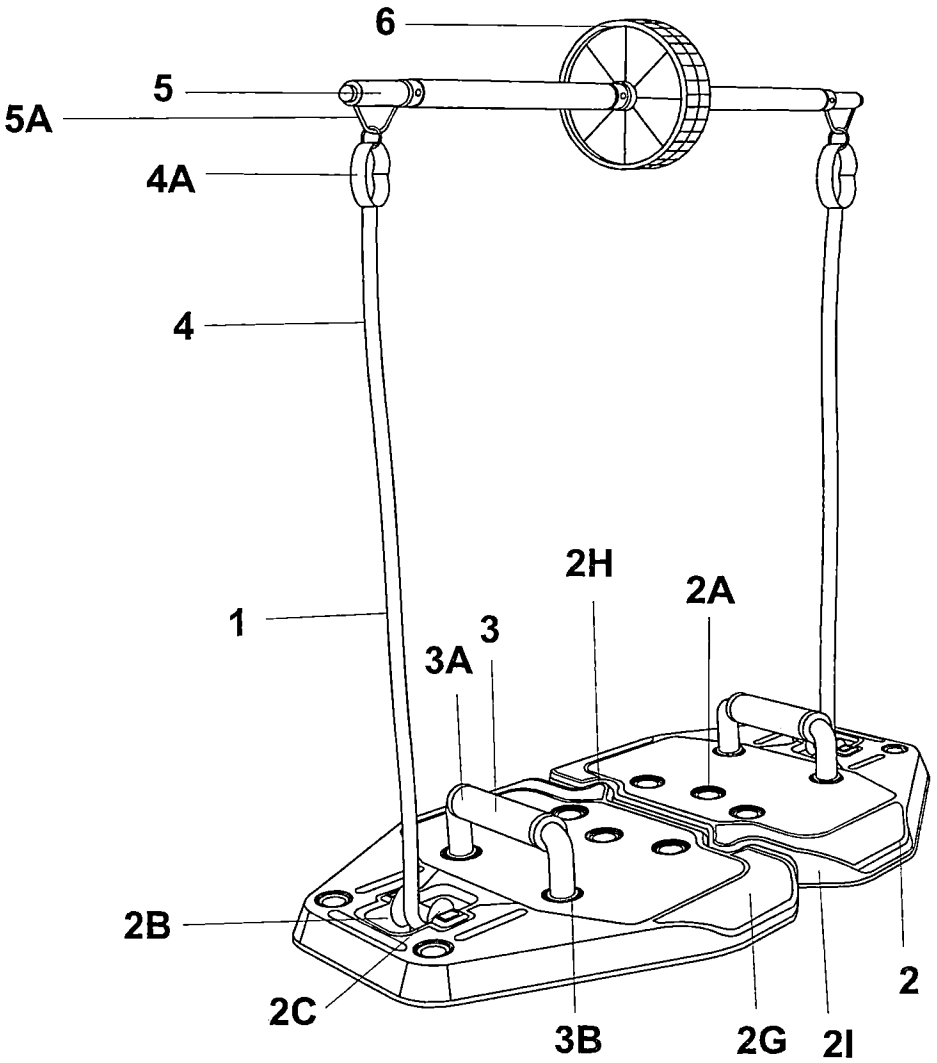
FIG. 1A represents a top view perspective of the multiple exercise machine arrangement.
Figure 1B:
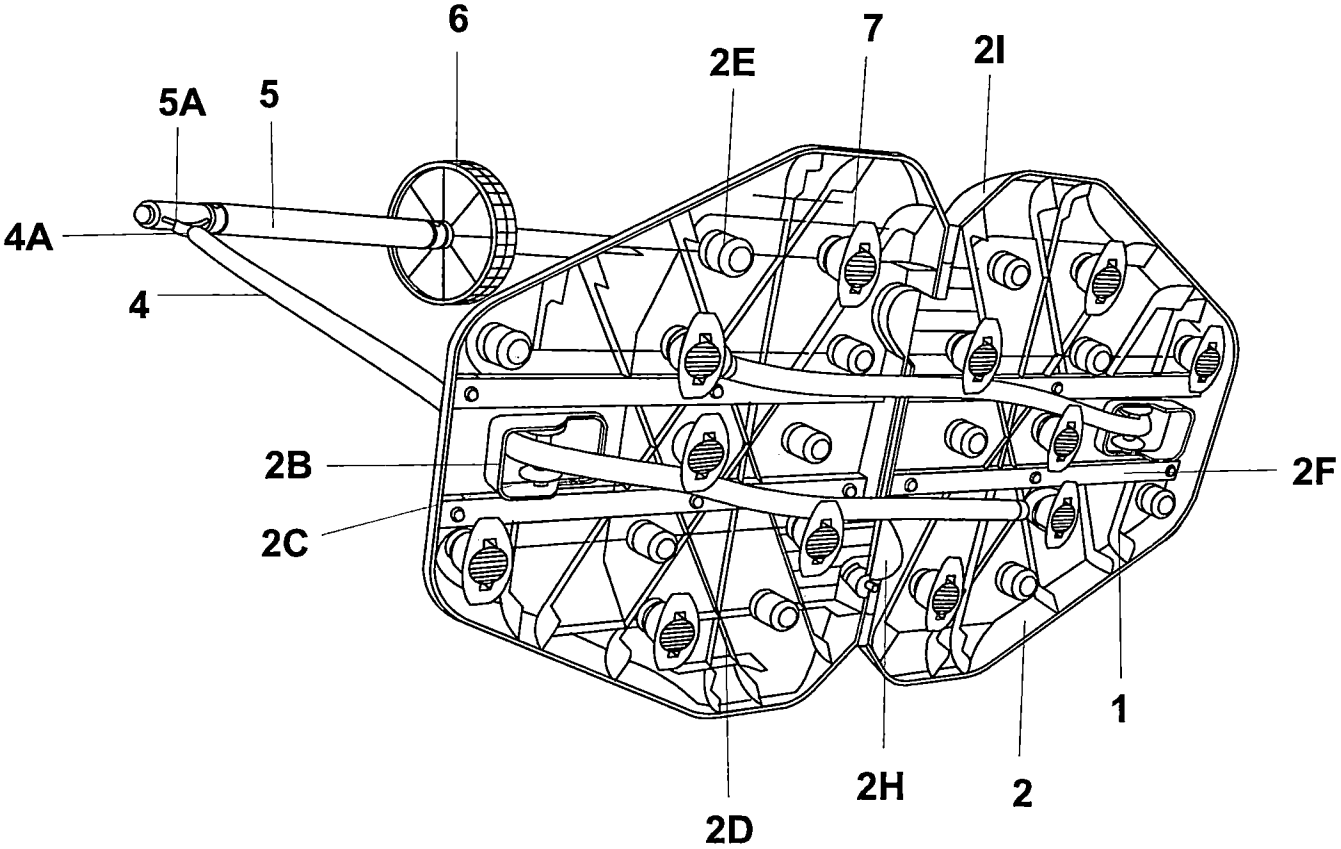
FIG. 1B represents a bottom view perspective of multiple exercise machine arrangement.
Figure 1C:
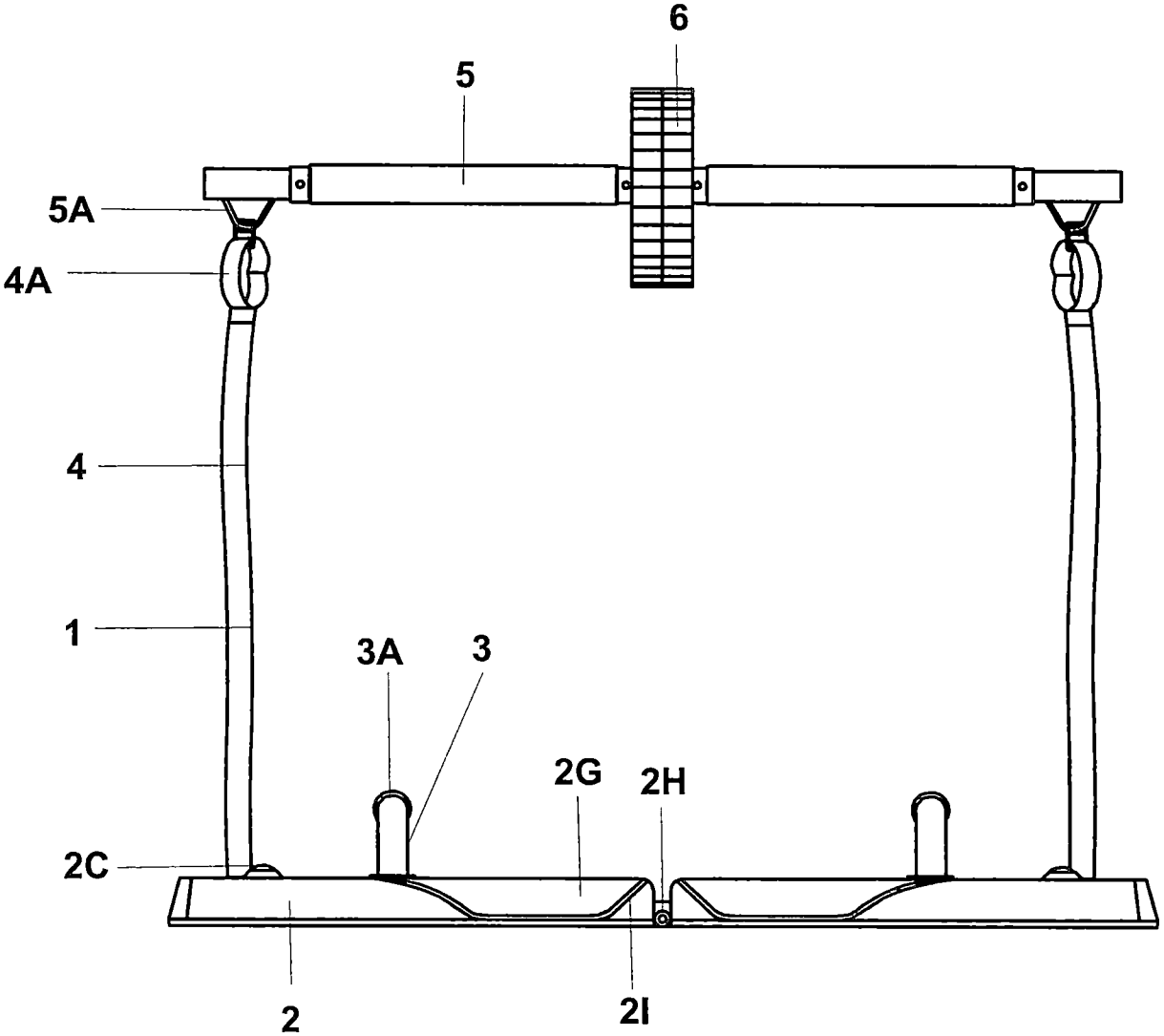
FIG. 1C represents a front view of the multiple exercise machine arrangement.
Figure 1D:
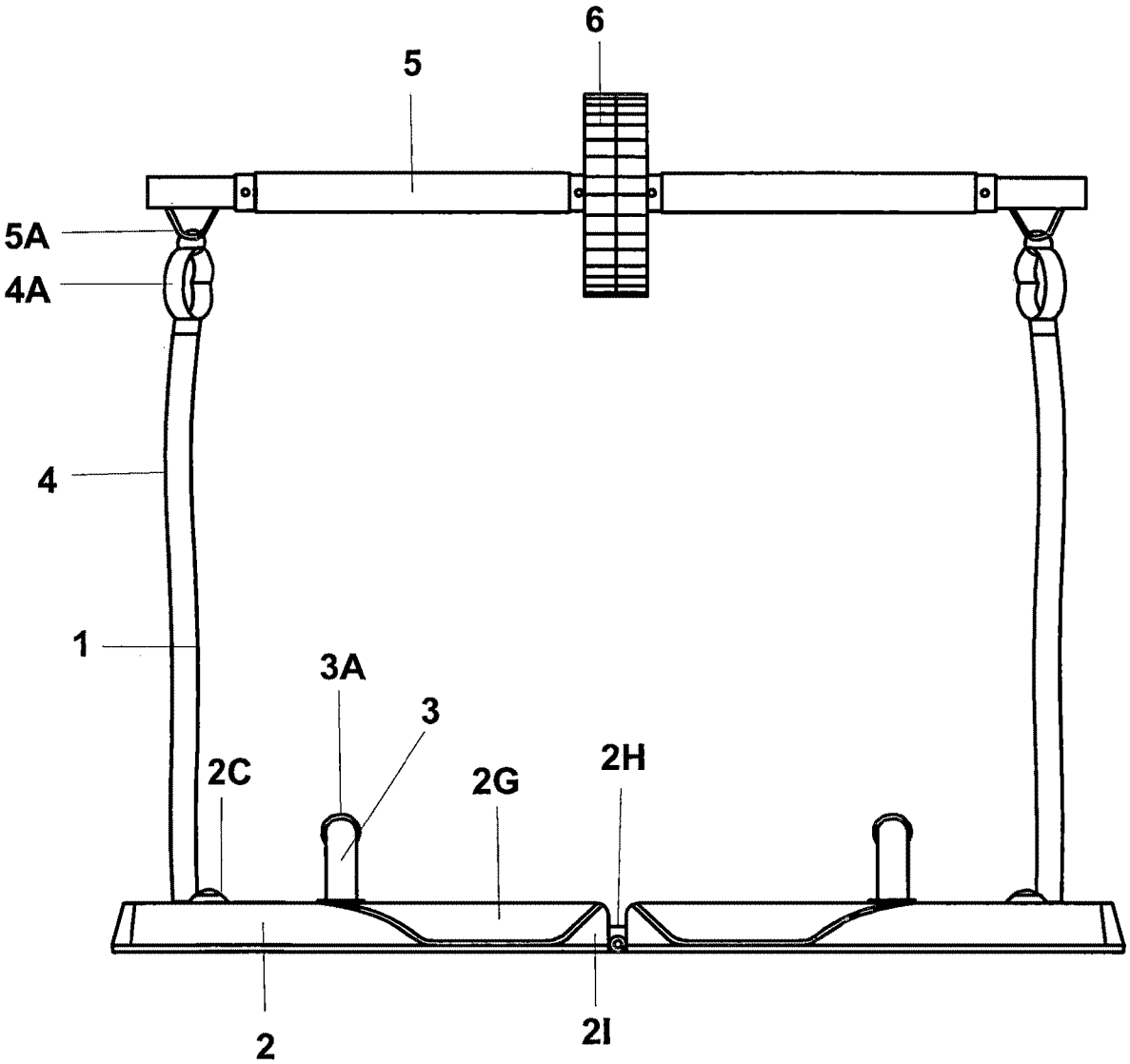
FIG. 1D represents a back view of the multiple exercise machine arrangement.
Figure 1E:
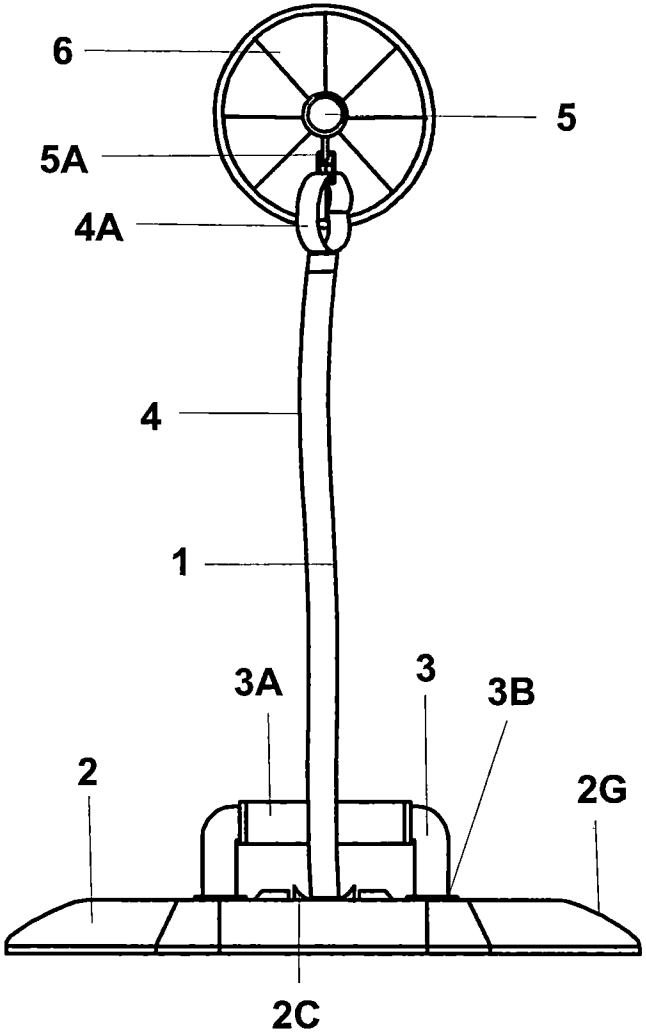
FIG. 1E represents a left side view of the multiple exercise machine arrangement.
Figure 1F:
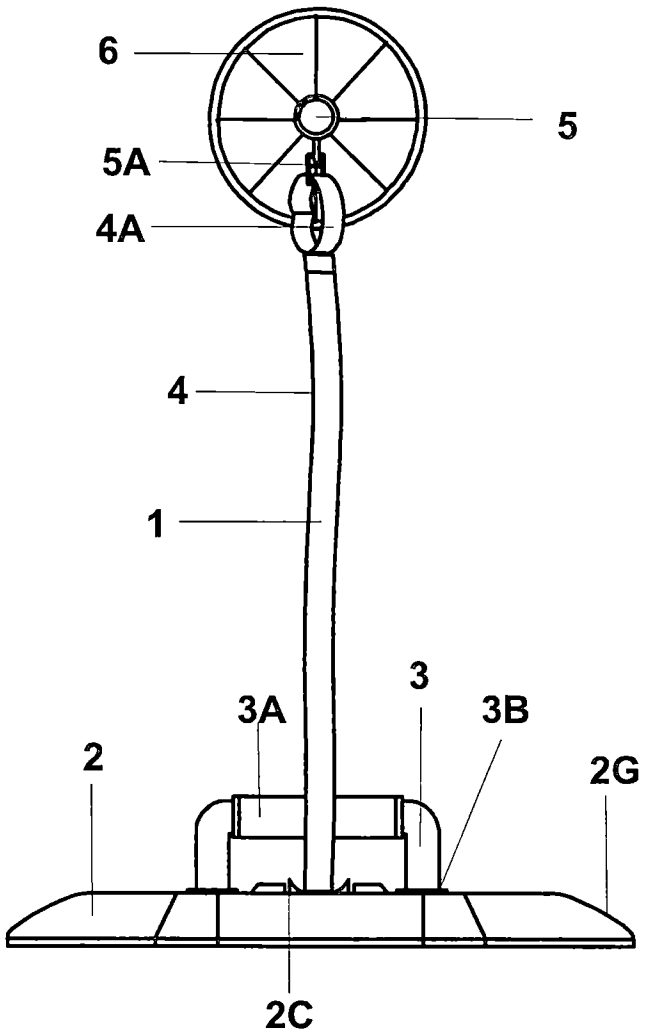
FIG. 1F represents a right view of the multiple exercise machine arrangement.
Figure 1G:
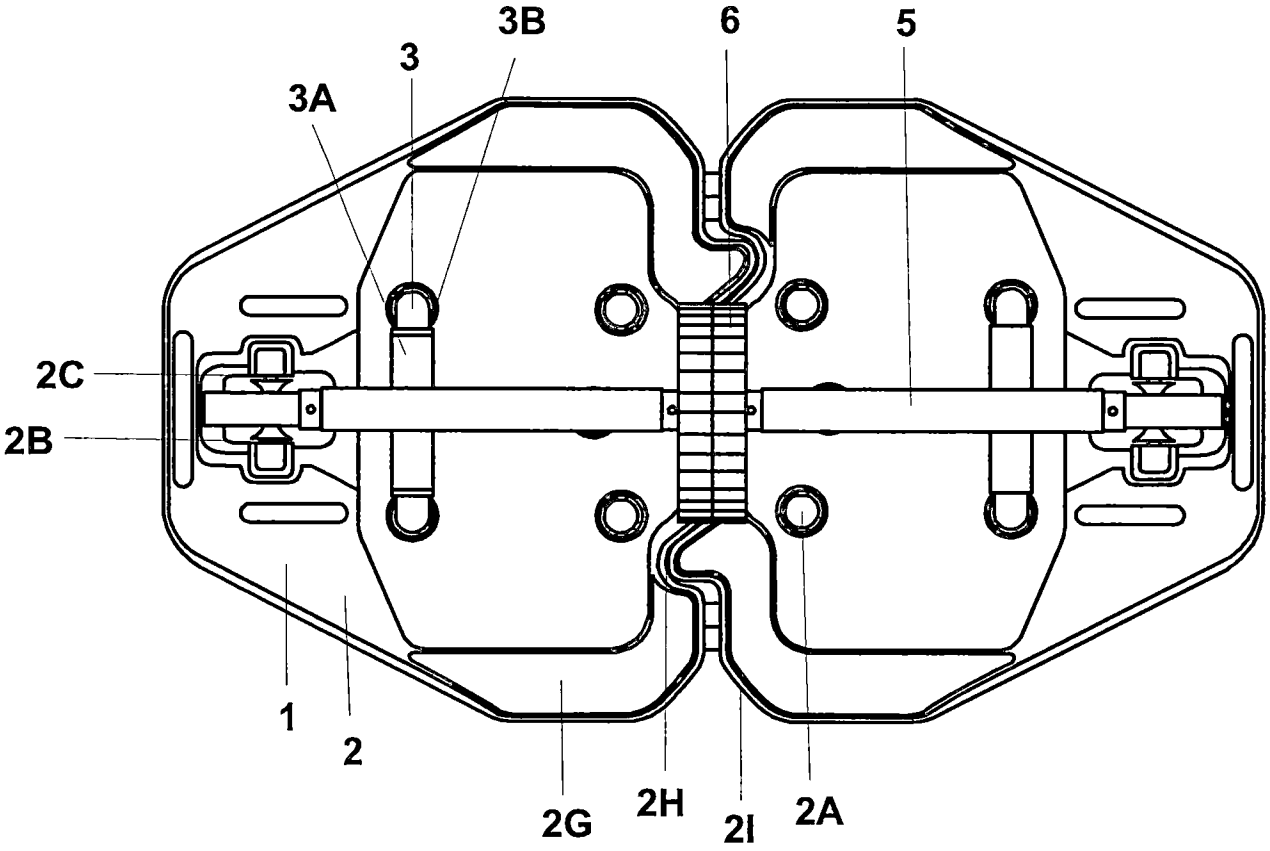
FIG. 1G represents a top view of the multiple exercise machine arrangement.
Figure 1H:
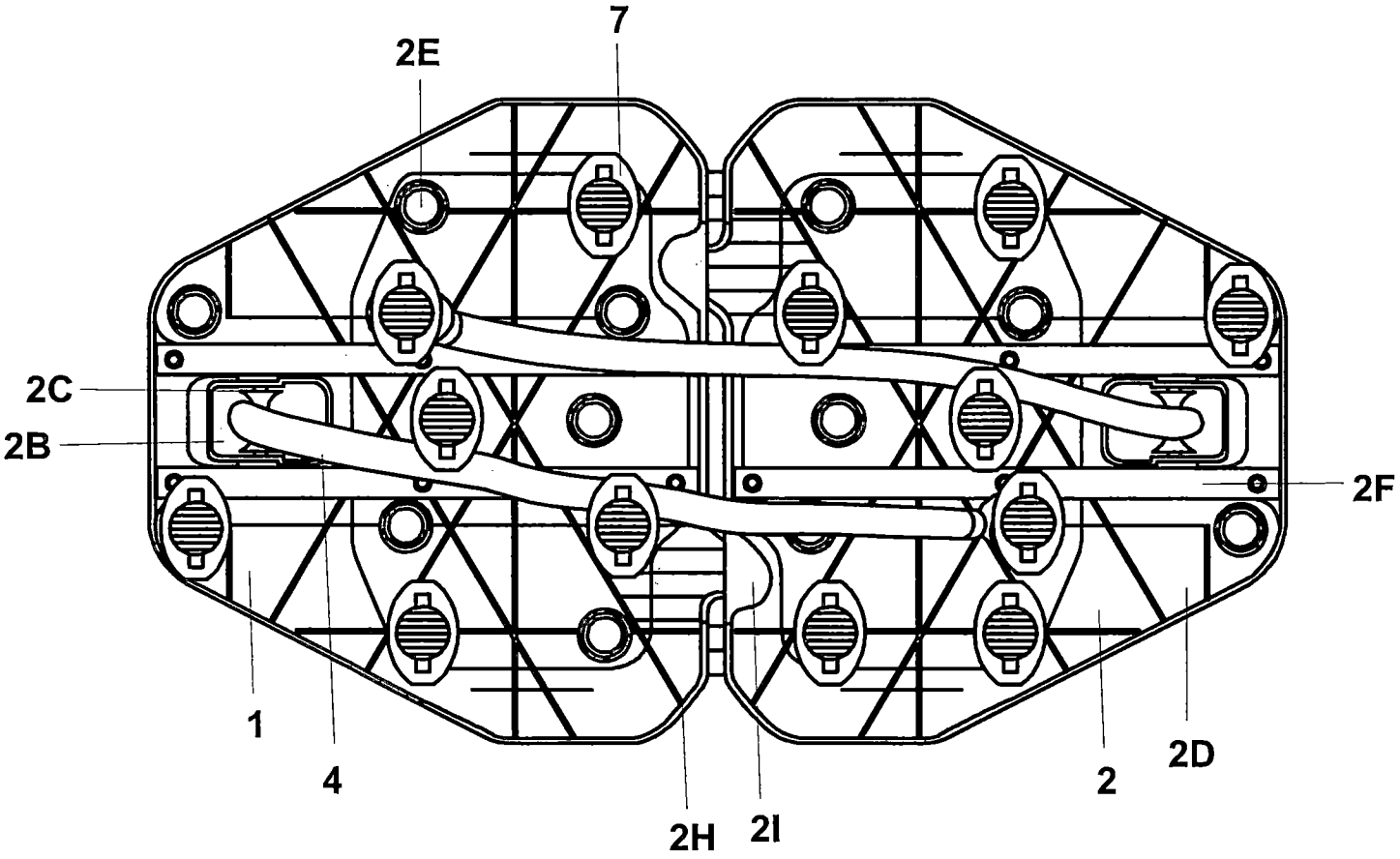
FIG. 1H represents a bottom view of the multiple exercise machine arrangement.
Figure 2C:
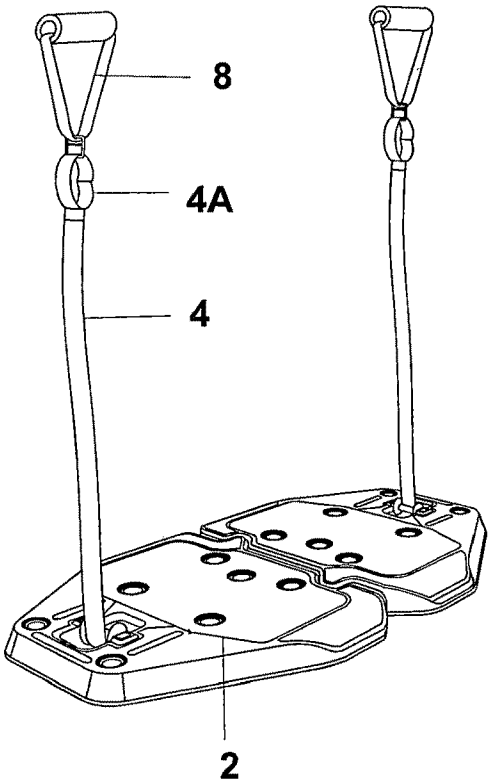
FIG. 2C represents a perspective view of the multiple exercise machine arrangement in the configuration with intermediary elastics and handles.
Figure 2B:
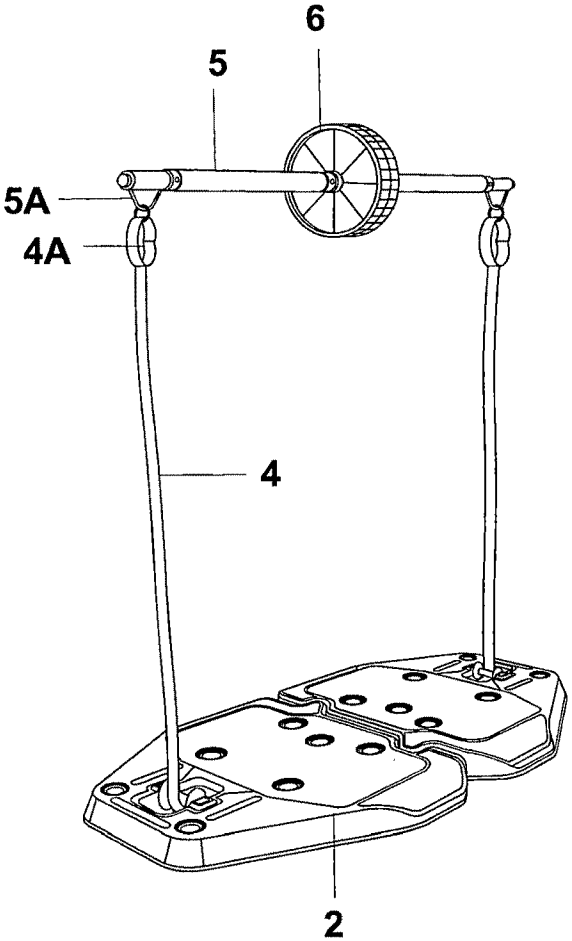
FIG. 2B represents a perspective view of the multiple exercise machine arrangement in the configuration with intermediary elastics, top bar, top wheels.
Figure 2A:
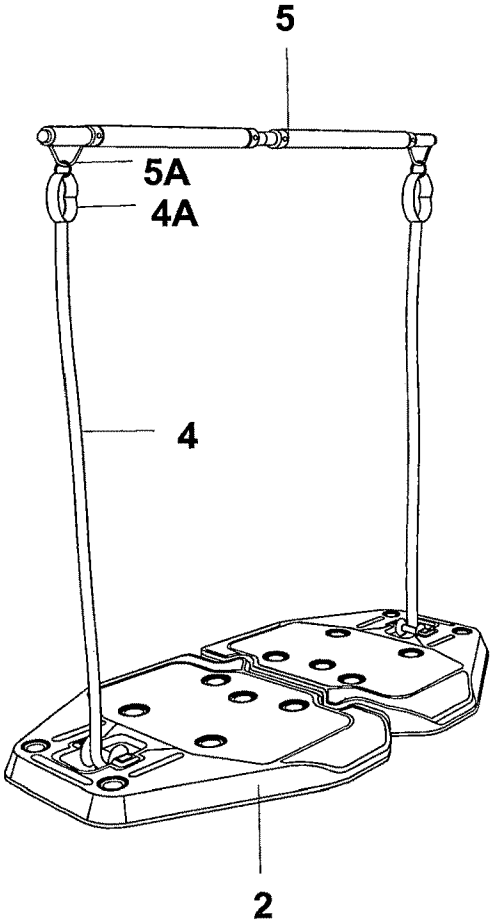
FIG. 2A represents a perspective view of the multiple exercise machine arrangement in the configuration with intermediary elastics and top two-part bar.
Figure 3B:
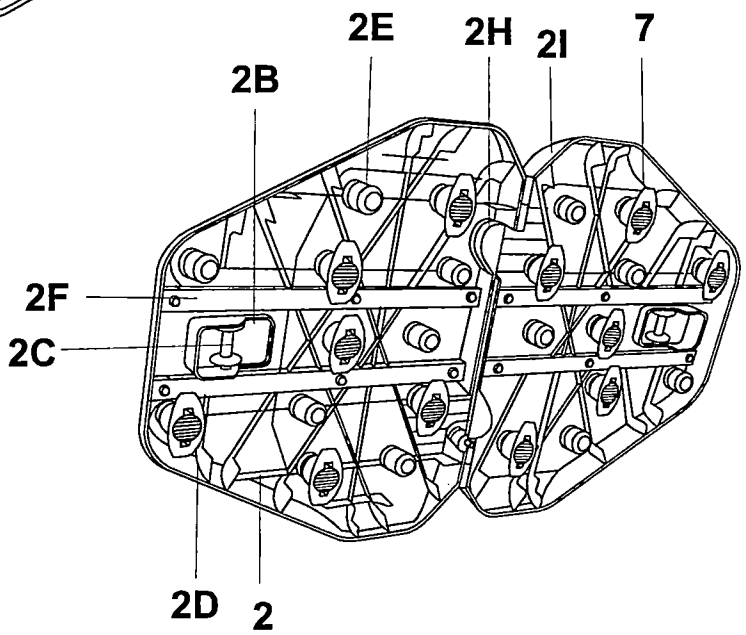
FIG. 3B represents a bottom view perspective of the two-part base of the multiple exercise machine arrangement.
Figure 3A:
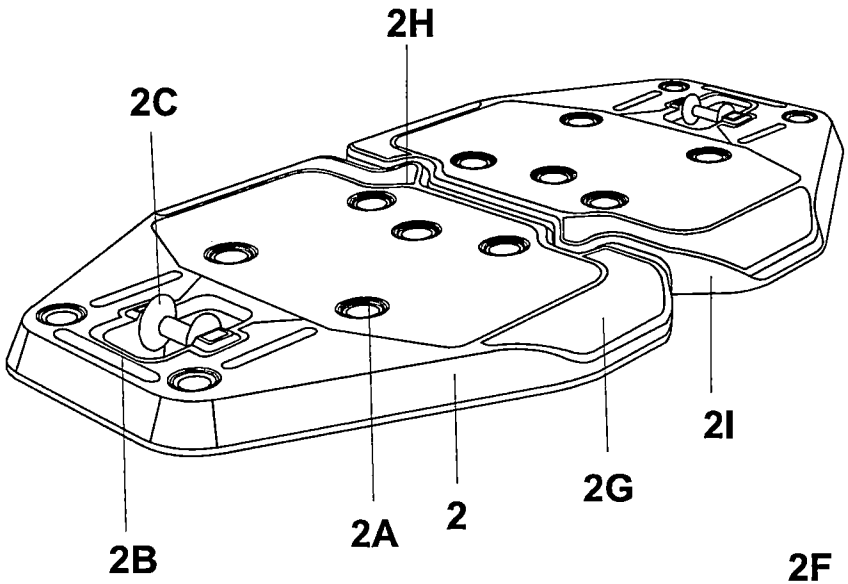
FIG. 3A represents a top view perspective of the two-part base of the multiple exercise machine arrangement.
Figure 3D:
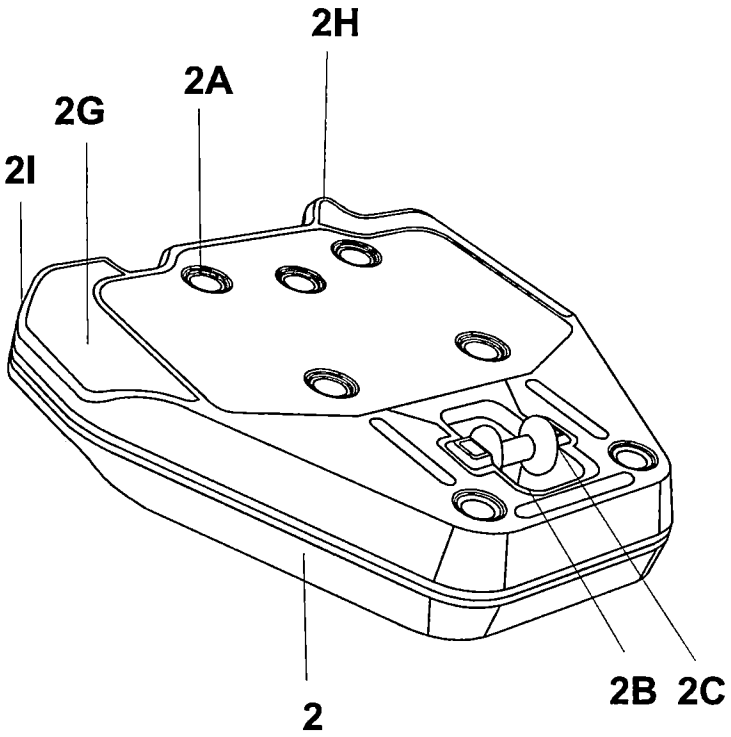
FIG. 3D represents a top view perspective of the two-part base of the multiple exercise machine arrangement in the folded position.
Figure 3C:
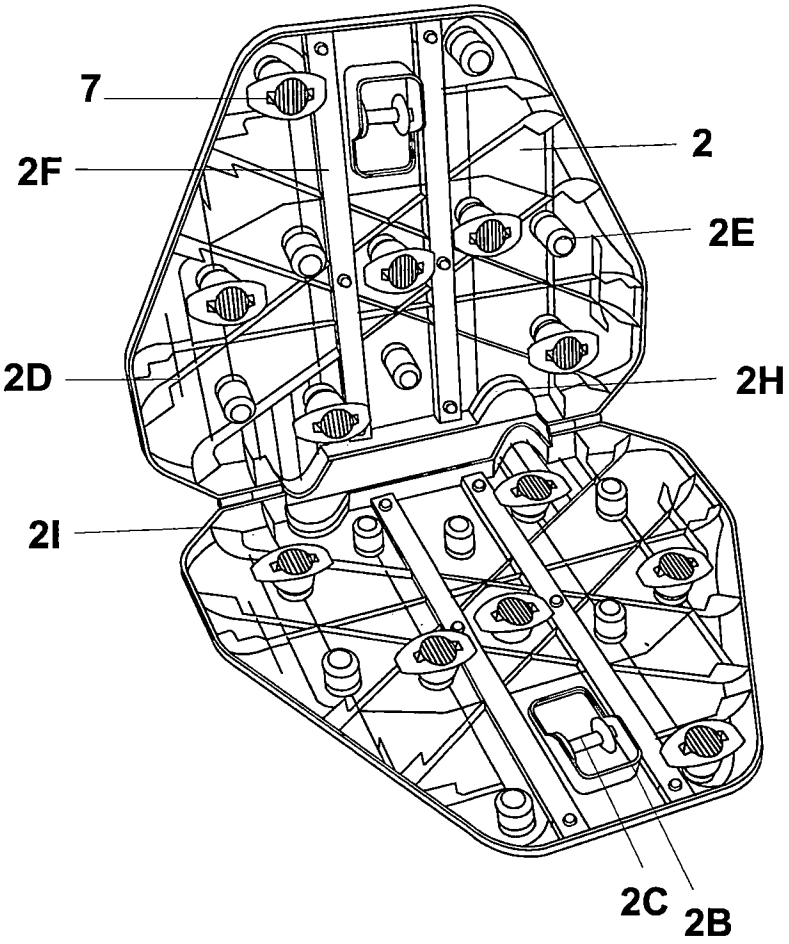
FIG. 3C represents a bottom view perspective of the two-part base of the multiple exercise machine arrangement in the semi-folded position.
Figure 4B:
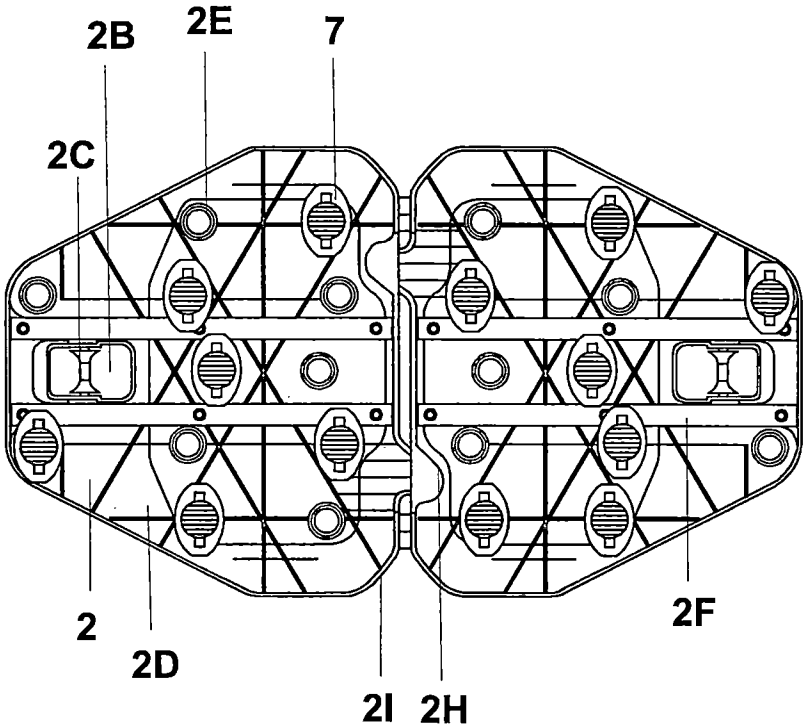
FIG. 4B represents a bottom view of the two-part base of the multiple exercise machine arrangement.
Figure 4A:
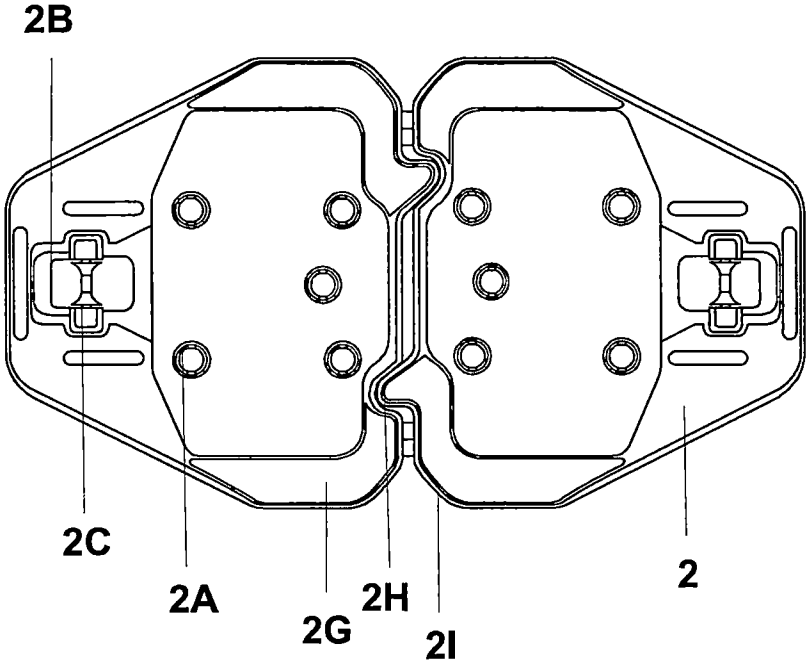
FIG. 4A represents an top view of the two-part base of the multiple exercise machine arrangement.
Figure 4D:
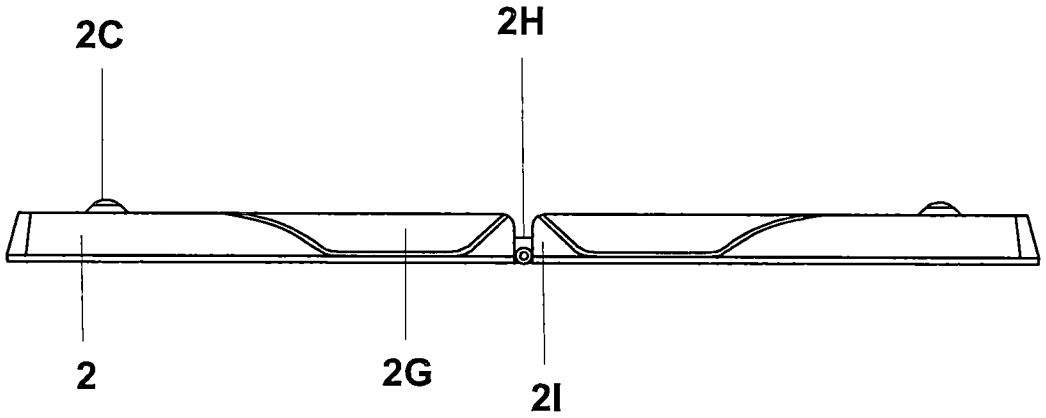
FIG. 4D represents a front view of the two-part base of the multiple exercise machine arrangement.
Figure 4C:
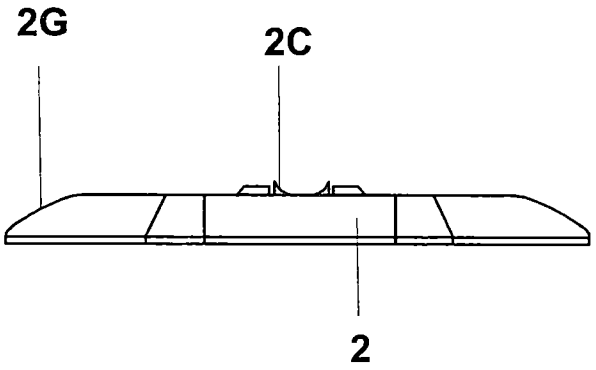
FIG. 4C represents a side view of the two-part base of the multiple exercise machine arrangement.
Figure 5:
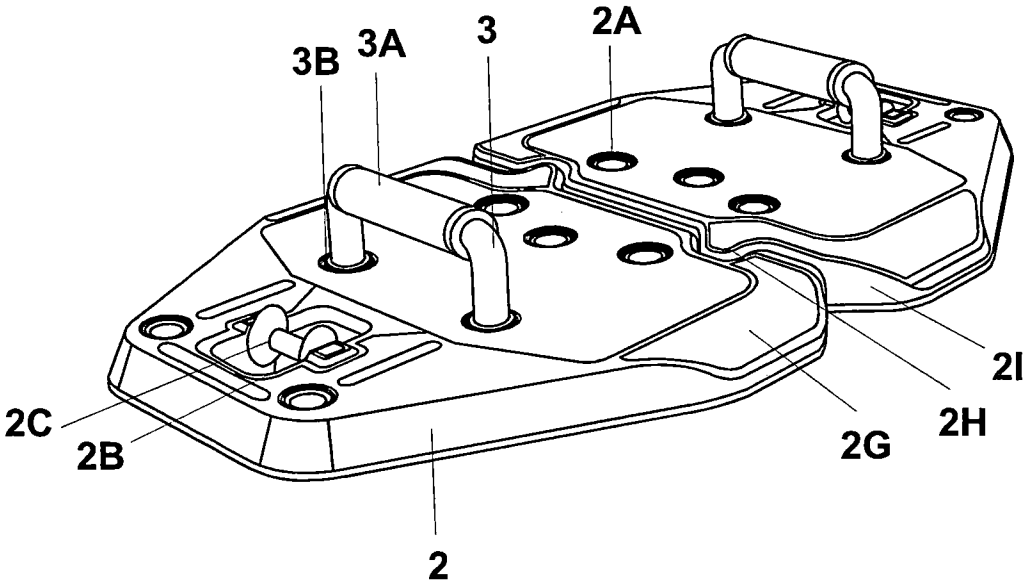
FIG. 5 represents a perspective view of the two-part base of the multiple exercise machine arrangement with the bottom supports.
Figure 6:
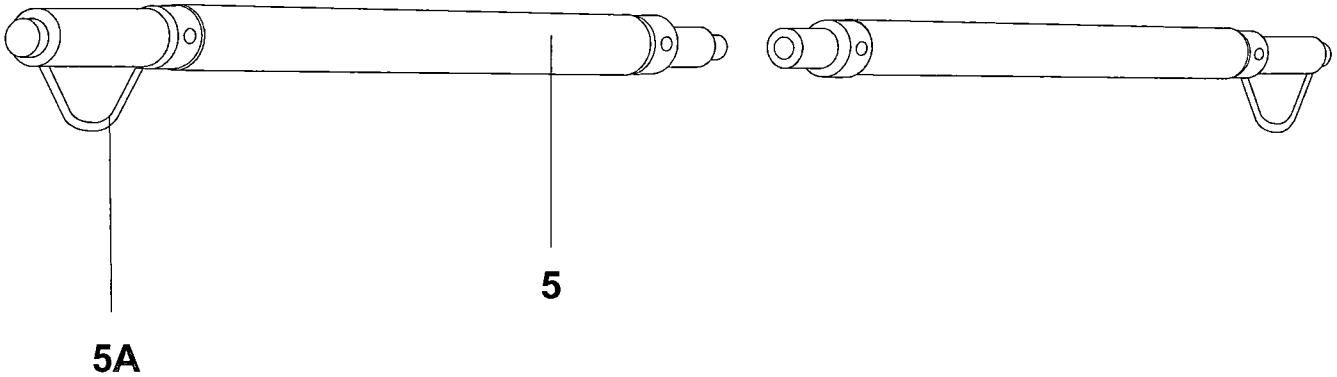
FIG. 6 represents a perspective view of the top two-part bar of the multiple exercise machine arrangement.

As shown in the figures in annex, which illustrate and integrate this descriptive report of the industrial design registry request of "Configuration Applied in/on the Exercise Machine", in FIGS. 1A-F it is presented in a general way, comprising a complete exercise machine (1) and with characteristics which incorporates its own specific mechanical type structure, highly durable and resistant, parallelogram shape with rounded edges, internal and external forms and arrangements which are adapted to the most diverse types of users and individualized physical exercises, and containing perfectly integrated and symmetrically arranged on a two-part base (2) in a hexagonal format and arranged horizontally and symmetrically along the entire length of the bottom part of the exercise machine (1), with the primary structuring function of the exercise machine (1); two bottom supports (3) with formats similar to an inverted "U" and arranged vertically and symmetrically over the base (2), with the primary function of bottom hand support; two intermediary elastics (4) straight in shape and each arranged vertically and symmetrically by crossing one side extremity of the two-part base (2) from the top extremity of the exercise machine (I) to the bottom face of the two-part base (2); with the primary function to support the hands to the top two-part bar (5); a top two-part bar (5) of a cylindrical format and arranged horizontally, perpendicular and symmetrically between the top extremities of the intermediary elastics (4) with the primary function to support the hands in an elevated position or on the floor; and a top wheel (6) of a cylindrical format and arranged vertically, perpendicular and symmetrically centered on the top two-part bar with e primary function of attaching or sliding the top two-part bar (5).

The two-part base (2) consists of or includes a set of openings (2A) cylindrical and arranged vertically and symmetrically along the entire length of the two-part base (2) as a fitting for the bottom supports (3), two side openings (2B) parallelograms and arranged vertically, parallel and symmetrically crossing the lateral extremities of the two-part base (2) as a cross for the intermediary elastics (4), two rollers (2C) (pulley) similar to a reel and each arranged horizontally and symmetrically across a lateral opening (2B) as a support for the cross of the intermediary elastics (4), a bottom hollow (2D) parallelogram and arranged horizontally, parallel and symmetrically along the entire length of the bottom face of the two-part base (2), a set of bottom pins (2E) cylindrical and arranged vertically, parallel and symmetrically spaced on and along the entire length of the bottom face of the two part base (2)—bottom hollow (2D) as supports of the two-part base (2) on the support floor, two pairs of straight bottom bars (2F) arranged horizontally, parallel and symmetrically centered and spaced on and along the entire length of the bottom face of the two-part base (2)—bottom hollow (2D) as structuring for the two-part base (2), bevels (2G) curved and arranged horizontally and symmetrically along the front and back extremities of the two-part bar (2), two central articulators (2H) triangular and arranged horizontally, parallel and symmetrically spaced and interspersed between the internal sides of the two-part base (2) as a two-part base joint (2), and two central cutouts (21) triangular and arranged horizontally and symmetrically centered on the front and rear faces of the two-part base (2)—adjacent to the bevels (2G).

Each bottom support (3) consists of an anatomical handle (3A) cylindrical and arranged horizontally and symmetrically around the entire length of the top part of the bottom support (3) as a support for the hands, and two bottom protrusion (3B) rings and arranged horizontally and symmetrically around the parts bottom supports (3).

Each intermediary elastic (4) consists of or includes two (4A) oblong hooks arranged vertically and symmetrically centered at the top and bottom extremities of an intermediary elastic (4), the bottom (4A) hook being fitted on a bottom pin (2E) as bottom attachment for the intermediary elastic (4), and the top hook (4A) fitted to a side extremity of the top two-part bar (5) as support for this one. 0036 The top two-part bar (5) consists of two side handles (5A) similar to an inverted "V" and each one arranged vertically, perpendicular and symmetrically under one side extremity of the top two-part bar (5), like the top hook hitch (4A). 0037 The multiple exercise machine arrangement according to the application needs, can be understood by bottom cylindrical (7) hollow locks with a transversal section similar to a "T" and each arranged vertically and symmetrically embedded around a bottom pin (2E), with the primary function of braking and generating pressure on the intermediary elastics (4).

The multiple exercise machine arrangement according to the application requirements, can be understood as two (8) oblong handles and each arranged vertically and symmetrically centered at the top end of a top hook (4A), with the primary function of top support for the hands.

The two bottom supports (3) integrated in the two-part base enable a wide range of physical exercises with the direct support of the hands on the anatomical handles (3A) among these the most diverse types and flexions such as open flexion, traditional flexion and closed flexion as well as open horizontal flexion, traditional horizontal flexion and inclined flexion. It should be noted that, it generates the possibilities of compositions of exercises and changing positions for positioning the bottom supports (3) transversally, longitudinally and inclined in relation to the two-part base (2) and therefore parallel, aligned and inclined to each other in the most diverse positions in the pairs of openings (2A).

It should be noted that the two-part base (2) and the two-part top bar (5) are also completely separable into two identical parts, to allow perfect and safe storage and transport.

It should also be noted that when the exercise machine (1) is in the position for storage or transport, the two-part top bar (5) is disassembled and stored symmetrically inside the bottom hollow (2D), as well as the two intermediary elastics (4) and all the bottom locks (7) embedded in the bottom pins (2E). 0042 The multiple exercise machine arrangement presents, as specific features of its structure and operation: curved (2G) bevels on the outer sides of the two-part base (2), making it possible to perform lying down exercises comfortably and safely on the extremities of the two-part base (2)—no nuisance or physical accidents; spacing between the central joints of the two-part base (2), to avoid crushing the hands when folding and transporting the exercise machine (1); bottom pins (2E) embedded in the two-part base (2), allowing excellent distribution of the stress on the floor and perfect closure of the two-part base (2); bottom supports (3) and openings (2A) with integrated fitting, allowing practical, safe and ergonomic handling of the bottom supports (3) during the exercises; bottom supports (3) and openings (2A) with integrated configurations, allowing a variety of exercise positions, as well as allowing the position of the bottom supports to be changed during the exercise (3), allowing exercises to be changed without interruptions; pairs of bottom bars (2F), allowing perfect structure and stability to the exercise machine (1), as well as a better distribution of the stress generated on the two-part base (2) and greater application of loads on the exercise machine (1), by eliminating possible deformations or even breaks while practicing exercises; intermediary elastics (4) organized on a two-part base (2), enabling perfect and safe arrangement near the two-part base (2) and preventing inconvenience and accidents while practicing the exercises; bottom locks (7), along with the bottom rollers, (2C) allowing a variety of extensions and stresses to the intermediary elastics (4), generating a wide range of exercises and loads during execution; intermediary elastics (4) acting along with the two-part base (5) and top wheels (6), enable a wide range of types of exercises integrated on the exercise machine (1); rollers (2C) (pulleys) and openings (2B), enabling the intermediary elastics (4) to work in a more fluid form, without any kind of locking during physical exercises; and the central articulators (2H), making it possible to fold both parts of the two-part base (2), folding and completely closing the two-part base (2) into one single block. 0043 Because the multiple exercise machine arrangement has its components fully integrated with each other, nothing is broken down and has nothing to break or bend, a high rate of performance and efficiency is achieved, coupled with high durability and absolute safety. Once fully integrated with each other, the components become cohesive, thus preventing them from loosening up on their own when in use, making the set fully available for the individual practice of a wide range of physical exercises in general. In this way, the exercise machine (1) can be used without concern of any nature, especially as regards the durability and safety of its components, in addition to the safety of users in buildings or construction sites.

Therefore, this is a product to practice physical exercise that will be well received by physical exercise enthusiasts in general, because the multiple exercise machine arrangement has numerous advantages, such as: excellent safety, reliability and agility upon using; great performance in its application due to its general design; high comfort, convenience and safety to users; very high resistance and general durability, coupled with low or no wear of the assembly as a whole; totally affordable costs which allows an optimal cost/benefit ratio; practical and safe use by any physical exercise enthusiast; wide range; general maintenance is very low and practical; perfect and straightforward adaptation to the most diverse types of physical exercises; high operational precision; high level of ergonomics in use; high comfort generation; and the certainty of having an exercise machine (1) that fully meets the current legislations and regulations and the basic conditions necessary for its application as a whole. All of these attributes allow the multiple exercise machine arrangement to be classified as a totally versatile, efficient, practical and safe means to be applied in the routine practice procedures of a wide range of physical exercises in an individual way, in the most diverse types of places and for the most diverse physical exercise enthusiasts, regardless of general characteristics that they can present, still being very easy to apply and handle, combined with great performance and excellent general characteristics; however dimensions and quantities may vary according to the general requirements of each of the applications.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A multiple exercise machine arrangement comprising:

an exercise machine having a two-part hexagonal base;

a plurality of supports attached to the two-part hexagonal base;

a pair of intermediary elastics, each arranged by crossing one side extremity of the two-part hexagonal base from a top extremity of the exercise machine to the bottom face of the opposite extremity of the two-part hexagonal base;

a top two-part bar arranged horizontally between tops of the pair of intermediary elastics; and a top cylindrical wheel arranged and centered on the top two-part bar, wherein the two-part hexagonal base having a set of cylindrical openings spaced along an entire length of the two-part hexagonal base, two side openings, two rollers, arranged transversally centered in a one of the two side openings, a bottom hollow arranged along an entire length of the bottom of the two-part hexagonal base, two pairs of straight bottom bars arranged centered and spaced on and along the entire length of the bottom face of the two-part hexagonal base.

2. The multiple exercise machine arrangement according to claim 1, wherein the two-part hexagonal base is in the folded position.

3. A method of exercising with the multiple exercise machine arrangement according to claim 1, comprising practicing physically exercising on the multiple exercise machine arrangement.

4. A method of transportation of the multiple exercise machine arrangements according to claim 2, comprising transporting the multiple exercise machine arrangement from one place to another.

5. A multiple exercise machine arrangement comprising:

an exercise machine having a mechanical parallelogram structure with rounded edges, containing an integrated and symmetrical arrangement of a two-part hexagonal base, the two-part hexagonal base horizontally and symmetrically arranged along an entire length of a bottom part of the exercise machine;

the two-part hexagonal base including:

a set of cylindrical openings, vertically and symmetrically spaced along an entire length of the two-part hexagonal base for fitting two bottom supports, wherein the two bottom supports are in a shape of an inverted "U" and are fitted and arranged vertically and symmetrically on the two-part hexagonal base in a subset of the set of cylindrical openings;

two parallelogram side openings arranged vertically, wherein lateral extremities of the two-part hexagonal base are parallel and symmetrical;

two roller pulleys, each horizontally and symmetrically arranged transversally centered in a side opening of the two parallelogram side openings;

a hollow bottom having a parallelogram shape and arranged horizontally, parallel and symmetrically along the entire length of the bottom of the two-part hexagonal base;

a set of cylindrical bottom pins arranged vertically, parallel and symmetrically spaced on and along the entire length of the bottom of the two-part hexagonal base;

two pairs of straight bottom bars, horizontally arranged, parallel and symmetrically centered and spaced under and along the entire length of the bottom of the two-part hexagonal base;

curved bevels arranged horizontally and symmetrically along the front and back extremities of the two-part hexagonal base;

two central triangular articulators arranged horizontally, parallel and symmetrically spaced and interspersed between internal faces of the two-part hexagonal base, and two triangular central cutouts horizontal and symmetrically centered on front and rear faces of the two-part hexagonal base, adjacent to one of the curved bevels;

two straight intermediary elastics, each arranged vertically and symmetrically, from a top of the exercise machine on one side extremity of the two-part hexagonal base, through one of the two parallelogram side openings, and to a bottom face of the opposite side extremity of the two-part hexagonal base;

a top two-part bar that is cylindrical and arranged horizontally, perpendicular and symmetrically between tops of the two straight intermediary elastics; and a top cylindrical wheel arranged vertically, perpendicularly and symmetrically centered on the top of the two-part bar;

each of the two bottom supports has a cylindrical anatomic handle arranged horizontally and symmetrically around an entire length of the top part of the respective bottom support, and two bottom protrusion rings arranged horizontally and symmetrically around bottom parts of each of the bottom supports;

each of the two straight intermediary elastics has two oblong hooks arranged vertically and symmetrically centered at top and bottom extremities of a respective intermediary elastic of the two straight intermediary elastics, with the bottom oblong hook attached to a bottom pin, and the oblong hook fitted to one side extremity of the top two-part bar; and the top of the two-part bar has two side straps in a shape of an inverted "V", each arranged vertically, perpendicularly and symmetrically on a side extremity of a top two-part bar and hooked on the top of the oblong hook.

6. The multiple exercise machine arrangement according to claim 5, further comprising hollow, cylindrical bottom locks with a cross-section in a shape of a "T" and each arranged vertically and symmetrically embedded around a bottom pin.

7. The multiple exercise machine arrangement according to claim 6, wherein the two-part hexagonal base is in the folded position.

8. The multiple exercise machine arrangement according to claim 5, wherein two oblong handles are each arranged vertically and symmetrically centered at the top extremity of the top oblong hook.

9. The multiple exercise machine arrangement according to claim 8, wherein the two-part hexagonal base is in the folded position.

10. The multiple exercise machine arrangement according to claim 5, wherein the two-part hexagonal base is in the folded position.

11. A method of exercising with the multiple exercise machine arrangement according to claim 5, comprising practicing physically exercising on the multiple exercise machine arrangement.

12. A method of exercising with the multiple exercise machine arrangement according to claim 6, comprising practicing physically exercising on the multiple exercise machine arrangement.

13. A method of transportation of the multiple exercise machine arrangements according to claim 7, comprising transporting the multiple exercise machine arrangement from one place to another.

14. A method of exercising with the multiple exercise machine arrangement according to claim 8, comprising practicing physically exercising on the multiple exercise machine arrangement.

15. A method of transportation of the multiple exercise machine arrangements according to claim 9, comprising transporting the multiple exercise machine arrangement from one place to another.

16. A method of transportation of the multiple exercise machine arrangements according to claim 10, comprising transporting the multiple exercise machine arrangement from one place to another.

* * * * *